US005613771A

United States Patent [19]

Siverling

[11] Patent Number: 5,613,771

[45] Date of Patent: Mar. 25, 1997

[54] SWINGS OUT OF THE WAY ARTICULATED MAGNIFYING LAMP

[76] Inventor: Michael M. Siverling, 519 28 St. NW., Rochester, Minn. 55901

[21] Appl. No.: 289,779

[22] Filed: Aug. 12, 1994

[51] Int. Cl.[6] ..... F21V 21/20

[52] U.S. Cl. ..... 362/401; 362/275; 362/402; 362/410; 362/419

[58] Field of Search ..... 362/275, 287, 362/401, 402, 410, 413, 414, 419, 427; 248/123.1, 289.1, 415, 414

[56] References Cited

U.S. PATENT DOCUMENTS

| | | | |
|---|---|---|---|
| 3,077,537 | 2/1963 | Squier | 240/81 |
| 3,160,755 | 12/1964 | Wolfe | 362/413 |
| 3,783,262 | 1/1974 | Pile | 362/427 |
| 3,994,464 | 1/1976 | Perbal et al. | 240/81 |
| 4,741,607 | 5/1988 | Heller | 248/123.1 |
| 4,772,991 | 9/1988 | Wood | 362/287 |
| 4,782,428 | 11/1988 | Lowell et al. | 362/11 |
| 4,819,138 | 4/1989 | Polick | 362/419 |
| 4,849,778 | 7/1989 | Samuelson | 354/81 |
| 4,919,380 | 4/1990 | Ely, Jr. | 248/364 |
| 4,974,135 | 11/1990 | Wen-Tsung | 362/401 |
| 5,033,705 | 7/1991 | Reagan | 248/123.1 |
| 5,139,220 | 8/1992 | Leonian | 248/122 |
| 5,170,975 | 12/1992 | Chadwick | 248/284 |
| 5,205,522 | 4/1993 | Nakamura | 248/123.1 |

FOREIGN PATENT DOCUMENTS

| | | | |
|---|---|---|---|
| 127157 | 1/1950 | Sweden | 362/413 |
| 871710 | 6/1961 | United Kingdom | 362/419 |

*Primary Examiner*—Denise L. Gromada
*Assistant Examiner*—Y. Quach

[57] ABSTRACT

The invention provides illumination and may provide magnified viewing of an object using a means which may be located directly in front of a seated or reclining individual, while providing for the means to pivot out of the way for easy egress from the sitting or reclining position. The invention provides a counter weight at a fixed radius for stability, and to facilitate the user's easy assessment of whether the counterweight will contact or interfere with nearby objects. The use of the fixed radius counterweight provides utilities that are not achieved when using a variable radius counterweight, or a weighted base configuration.

15 Claims, 5 Drawing Sheets

SWINGS OUT OF THE WAY ARTICULATED MAGNIFYING LAMP

FIELD OF THE INVENTION

The present invention pertains to illuminating devices and more particular to an articulated lamp including a counterweight for stability.

BACKGROUND AND SUMMARY OF THE INVENTION

Lamps, and even magnifying lamps have been used for industrial applications, but the present embodiments are not well suited for home use; particularly home use by the elderly who need good illumination and may need accompanying magnification of objects to continue to participate in activities that require visual acuity. An objective for an illumination and magnification embodiment suited to their needs is that the embodiment be relatively light weight and have the center of mass located close to where one would grasp it to pick it up. Another objective is that the embodiment not interfere with egress from a seated position by the infirm. Other objectives are: that the embodiment needs to be durable, stable, and not be complex to use. Further, the embodiment needs to have a compact configuration for ease of storage in a limited space environment. The lamp of the present invention meets all of these objectives. The lamp of the present invention uses a lamp head mounted on an articulated arm with lamp supporting electrical hardware, much like those presently sold for mounting on commercial drafting tables. To this is added a counterweight at a fixed radius from the horizontal center of rotation, radially opposed to the movement of the articulated arm. This assembly rotates on a very light weight stand. This invention uses an improved counterweight strategy wherein a counterweight is at a fixed horizontal radius in opposition to the arm articulation, and positioned well above the floor level. This eliminates the tendency for the base to swing awkwardly like a heavy pendulum when carried. (The bases of heavy based devices tend to swing about the point where they are grasped when carried and that effect makes those devices cumbersome to carry.) The lamp of the present invention, using the improved counterweight strategy where the counterweight is at a fixed horizontal radius, has a preferred counterweight radius such that the counterweight does not contact a wall when the stand is placed in its closest proximity to the wall. This relationship allows the user to easily avoid physical interference between the counterweight and nearby objects. The fixed radius counterweight provides stability from upset while allowing the lamp of the present invention to be half the weight of heavy base-stabilized embodiments. The preferred embodiment of the lamp of the present invention has a light weight fixed base removable for storage or transport.

The stability is adequate for using the lamp of the invention while reclining in the middle of a large bed with the invention's base placed at the side of the bed. Further, a light horizontal push on the lamp head perpendicular to the articulated arm will cause the lamp head and articulated arm assembly to rotate out of the way for easy egress from the bed. The base of the lamp of the invention may be placed beside a chair so that when the lamp head and articulated arm are rotated to the side there is no interference with egress, even when a walker or other convalescent aid is used. Further, if only rotation was imparted to the pivotal structure to move it out of the way for egress, the pivotal structure may be pulled, rotationally, back into position upon return with no further adjustments being necessary.

When the lamp of the invention's base is removed and folded for storage, as well as the articulated arm folded tightly upon itself, the lamp of the invention offers a unique solution to salesmen who need a compact light weight transportable device to show very small products to prospective customers. The lamp of the invention provides magnification and illumination from floor level, where a pet's paw may be examined, to above the head of an adult seated on a chair, where the adult's head could be examined, with no adjustment to the invention below the level of its horizontal rotation. To reach these positions, the lamp head is simply grasped and pulled or pushed into the desired position. The preferred embodiment uses a low profile multiple leg design such that the legs can easily fit under most furniture and presents a wide base for stability on carpeted floors. The combination of: the wide base footprint, the fixed counterweight rotating in opposition to the direction of articulated arm extension, and the low vertical height at which both horizontal rotation and arm articulation occur allow the lamp head to take up a new desired position when force is applied, rather than upset the whole assembly.

BRIEF DESCRIPTION OF THE DRAWINGS

The novel features believed characteristic of this invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
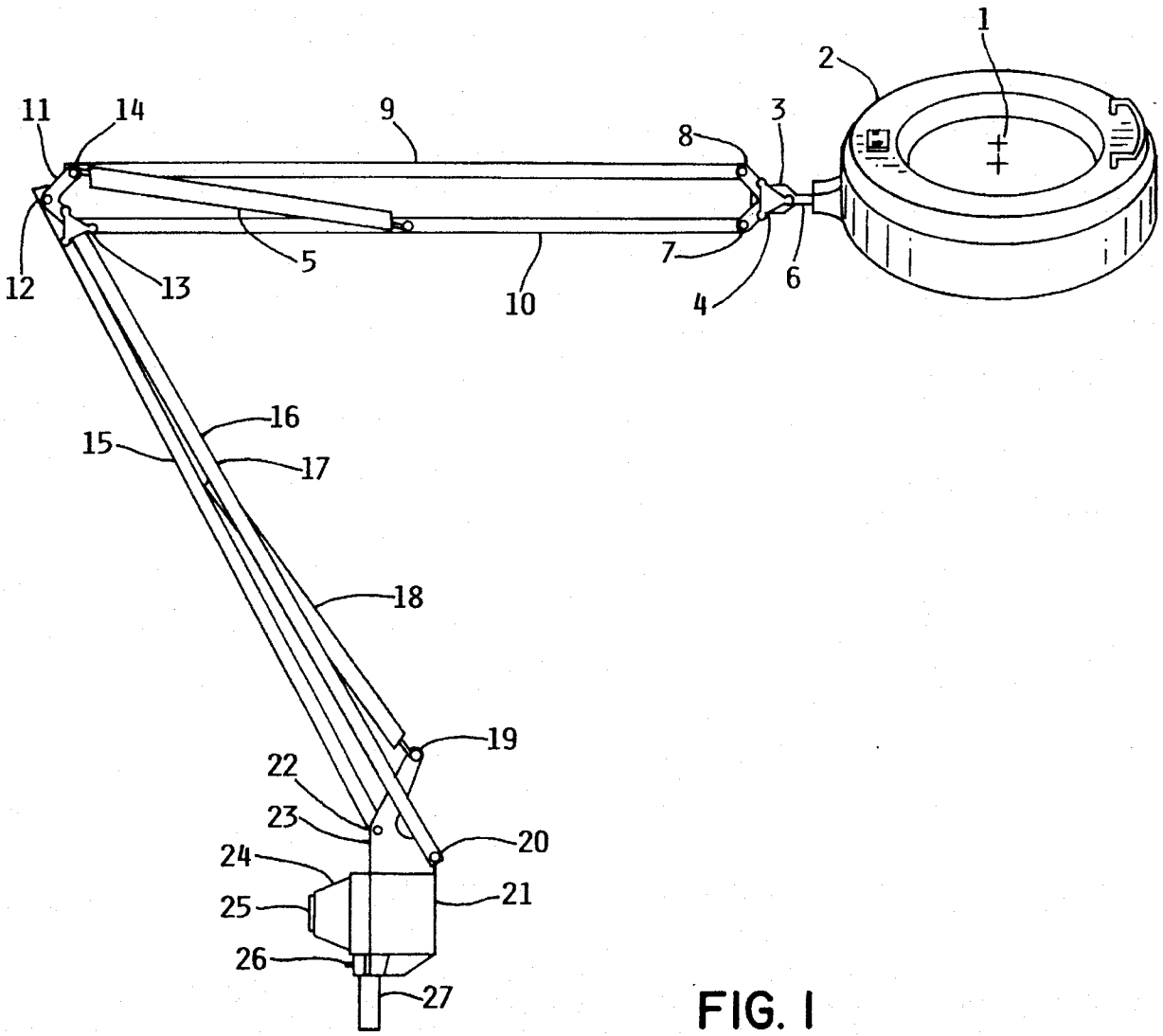
FIG. 1 is a pictorial representation of a preferred embodiment of the lamp of the invention's pivotable structure with the counterweight assembly excluded.

With reference now to the figures, and in particular with reference to FIG. 1, there is depicted a pictorial representation of a lamp structure having a lamp head 2 providing illumination and containing a magnifying lens 1. This lamp head 2 is connected to an articulated arm structure. The articulated arm is connected to housing 21 through mounting flange 23. Housing 21 provides an enclosure for electrical components associated with the illumination, as well as an entry point for the electrical cord (not shown) and a mounting surface for electrical socket 25. The housing 21 attaches to vertical shaft 27. This lamp structure, as depicted, is presently marketed as an aid for draftsmen, and is sold with an accompanying bracket (not shown) which mates to shaft 27 and mounts the lamp firmly to a drafting table or workbench. The assembly depicted in FIG. 1 is a portion of a commercially available drafting aid product. The assembly depicted in FIG. 1, with the counterweight assembly depicted in FIG. 2 form the pivotable structure referenced in the later portions of this specification. It is important to the operation of this invention that assembly depicted in FIG. 1 provides the following three functions. The first function is that lamp head 2 is constrained to remain in a fixed vertical plane relative to features on housing 21, determined in this embodiment by arm mounting flange 23 when wrist locking knob 4 is tightened so as to lock the wrist 3. Within this function if lamp head 2 rotates horizontally about an axis coincident with the vertical centerline of vertical shaft 27, all portions of the assembly including housing 21 will tend to rotate by this angular magnitude. Lamp head 2 does have the, freedom to move radially with respect to the centerline of vertical shaft 27 and vertically with respect to housing 21. Lamp head 2 has two additional degrees of freedom acheieved by rotation of wrist 3 and about the axis of wrist extension 6. The second function is that the articulated arm has a aeries of spring means 5,18 which relieve the weight that would otherwise be apparent when raising lamp head 2. The third function is that the joints in the articulated arm have a means, and preferably an adjustable means, e.g. knobs 4,13, of providing friction to the joints in the articulated arm so as to achieve a comfortable level of arm stability for the user. In FIG. 1, the knob 13 provides variable friction which must be overcome to move the arms 9,10 relative to arms 15,16,17 with arm 17 being identical to ann 16 and behind it. Knob 13 also provides the friction that must be overcome to move arms 15,16,17 relative to mounting flange 23 by controlling the friction required to rotate element 11 relative to arms 16,17. In doing this, knob 13 provides fiction against changing the included angle between element 11 and arms 16,17 of the polygon which has sides of fixed length and whose four adjustable angles occur at the horizontal hinge element behind knob 13 and at horizontal hinge elements 12,22,20. Those skilled in the art will recognize that by controlling one adjustable angle of the polygon, the other three adjustable angles will also be controlled. Similarly, by controlling the force required to alter the angle between clement 11 and arm 10 knob 13 provides fiction against rotation at hinge points 7,8 and 14.

Figure 2:
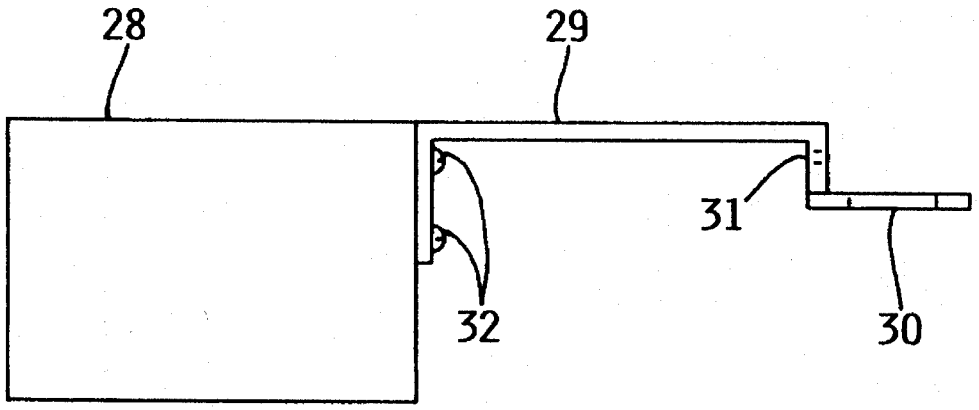
FIG. 2 is a pictorial representation of a preferred embodiment of the lamp of inventions counterweight assembly.

FIG. 2 is a pictorial representation of the counterweight assembly. It consists of: a mass or counterweight 28 fastened to an attachment arm 29 by fastening system 32. In this preferred embodiment, the attachment ann 29 has a hole 30 which is passed over vertical shaft 27 shown in FIG. 1. Screw 26 which is provided to secure cover 24 to housing 21 is removed and is replaced by a slightly longer screw 26 which passes through hole 31 shown in FIG. 2 and is again installed as screw 26 asa depicted in FIG. 1. Screw 26 thus secures both the cover 24 and the attachment arm 29 to homing 21. Fastening the counterweight 28 in this manner allows the dale of the previous product, with its old utility, without retooling to provide the enhanced functions and increased utility of this invention.

The attached arm and counterweight, when properly installed must fulfill a mathematical relationship based on a fulcrum (not pictured) that is related to the points of coma between the stand (FIG. 3) and the horizontal supporting surface, and which is a horizontal line of minimum distance from the centerline of shaft 27 and perpendicular to it, about which the entire assembly (shown in FIG. 6) would rotate in a vertical plane in order to tip over. The fulcrum may be a line extending between the points of contact with the floor for two of the stand's feet when the articulated arm is extended perpendicular to that line. The mathematical relationship uses the products of all mass elements (including the counterweight assembly) times the horizontal distance between their centers of mass and the fulcrum previously defined. The mathematical relationship is that the sums of the products must be such that the sum of all these products on the shall 27 side of the fulcrum shall be greater than the sum of all products for mass on the other side of the fulcrum when the articulated arm is fully horizontally extended. This relationship allows the calculation of the minimal counterweight attachment arm product to achieve total stability. This product becomes the input to the relationship of total weight of the embodiment to its maximum stable horizontal extension.

Figure 3:
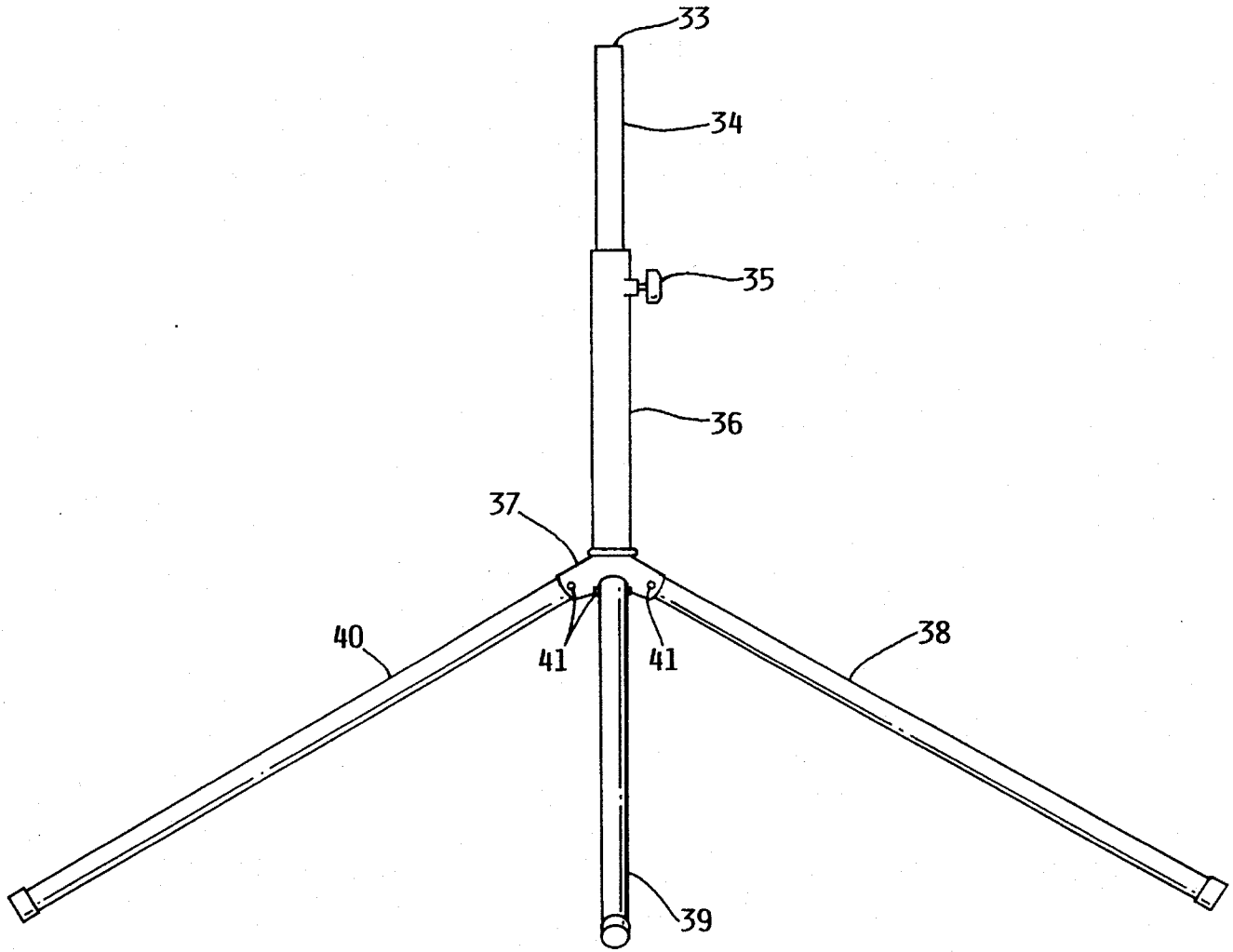
FIG. 3 is a pictorial representation of a preferred embodiment of the lamp of the invention's stand.
Figure 4:
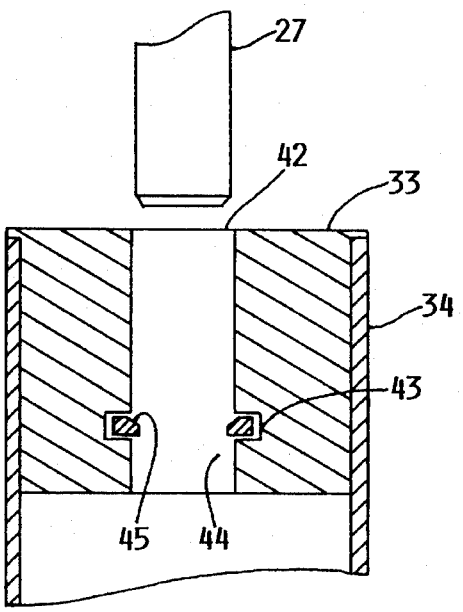
FIGS. 4 and 5 show two treatments for joining the lamp of the invention's pivotable structure to the stand that provide force dependent separation of the pivotable structure from the stand.
Figure 5:
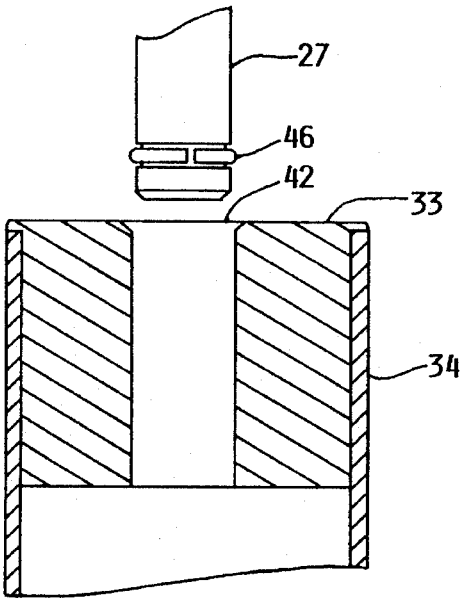

FIG. 3 is a pictorial representation of a preferred stand embodiment. A collar 33 provides pivot, attachment, and support functions, for the pivotal structure (all the hardware included in FIGS. 1 and 2). Collar 33, detailed in FIGS. 4 and 5, is fitted to the upper end of vertical tubular section 34. Tubular section 34 may be telescoped into a second vertical tubular section 36 and secured with screw fastener 35 for achieving greater utilities based on having adjustable height of the pivot point associated with collar 33. The lamp of the invention achieves all of the utilities previously described without the telescoping sections, however, greater utility is achieved with the telescoping sections, including a more compact form factor for storage when the-telescoping sections are at minimum extension. The lower end of the lowest vertical tubular section 36 is fitted to a flange 37 which is formed to receive a plurality of legs 38,39,40 which extend radially and downward from the flange 37. The embodiment in FIG. 3 depicts a means wherein the legs 38,39,40 may be folded down parallel to the vertical tubular section 34 for storage, but are restrained in the upwards motion of their ends during use by the legs bearing against the flange 37.

FIGS. 4 and 5 detail two methods of making the collar 33 so as to achieve requirements of the preferred embodiment of the lamp of the invention. Those requirements are: that the attachment provide a low friction support and pivot for the pivotable assembly (all the items associated with FIGS. 1 and 2), and that it provide frictional restraint resisting withdrawl of shaft 27 from collar 33 such that when the pivotable assembly is grasped and raised, the lightweight stand will be raised with it. FIG. 4 shows a method of achieving these objectives without modification of the shaft 27. This method has the advantage of not requiring retooling or remachining of shaft 27 beyond its previous use in a draftsman's lamp. Thus the old subassembly may continue its use in the old utility, while being suitable for this invention's new and greater utility without modification. A portion of shaft 27 is shown in position to be inserted into collar 33. Collar 33 is interference fitted or bonded into tubular section 34. Hole 42 passes vertically through collar 33 and provides a snug, but low friction fit to shaft 27. Interior to hole 42 is an annular grove 43 sized to receive and retain slotted ring 44 which is formed of a spring type stock The interior hole in slotted ring 44 is sized to be an interference fit on shaft 27. Further slotted ring 44 is sized to be a loose fit in annular groove 43 even when the slotted ring 44 is distended by shaft 27 passing through its interior. Thus, it provides frictional restraint to shaft 27 being withdrawn vertically, while allowing rotational freedom to shaft 27. The upper surface of collar 33 provides the weight bearing surface for the pivotal assembly. The upper entrance to the interior hole in slotted ring 44 is chamfered 45 to make the ring serf aligning to shaft 27 when the shaft is inserted.

FIG. 5 depicts a second method for achieving the requirement set forth for collar 33. The method depicted in FIG. 5 shows a collar 33 inserted into tubular section 34 with an interference, or bonded fit, to tabular section 34. The hole 42 provides a snug but low fiction fit for shaft 27. Split ring 46 provides a high friction fit when inserted into hole 42, but its interior diameter when inserted is sized to remain loose on shaft 27. Thus ring 46 provides for low friction during shaft 27 rotation, while providing high friction for the extraction of shaft 27. The upper surface of collar 33 provides the vertical support for the pivotal assembly associated with shaft 27.

Figure 6:
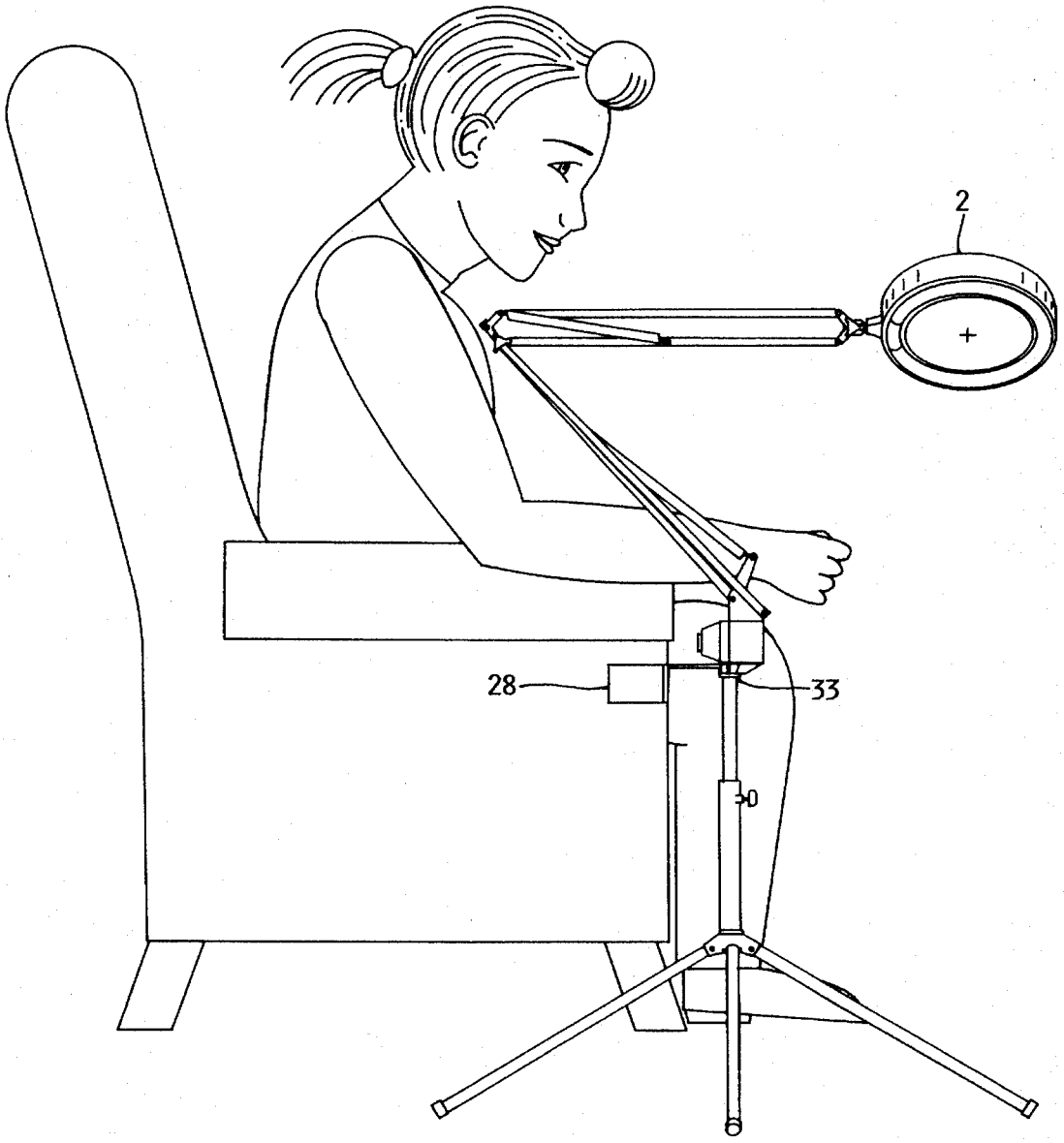
FIG. 6 is a pictorial representation of the fully assembled lamp of the invention. It also indicates a preferred usage of the lamp of the invention positioned so that it may be pulled rotatively into position for use, as well as pushed rotatively to a position which does not interfere with egress.

FIG. 6 depicts the assembled invention. Collar 33, interfaces between the fixed stand portion (of which it is part) located at below it, and the pivotable structure above it. The electrical wiring and electrical cord are not shown.

Further, FIG. 6 depicts the invention in the preferred position for arm chair use of the invention. As pictured, the invention is rotated out of the way for egress from the chair by the user. To employ the invention, the user would grasp the lamp head 2 and rotate it about the axis provided by the collar 33 into a position wherein the lamp head 2 is interposed between the user's eyes and hands. In this embodiment, the counterweight 28 would easily pass below a table surface set beside the chair with the invention placed between the chair and the table.

The lamp of this invention exhibits high stability from upset while being of light weight. For purposes of describing how the lamp of this invention achieves this stability, the following definitions will be used. The footprint of the lamp stand is the plurality of points of contact between the stand and its supporting structure. The footprint perimeter is a polygon formed of the minimum number of straight line segments which connect two points of contact and which enclose the plurality of points of contact between the stand its supporting structure. A fulcrum for upset is that horizontal line about which the structure would rotate in a vertical plane when experiencing upset. These fulcrums will generally occur coincident with one of the line segments of the defined footprint perimeter. Given the preceding definitions, the stability from upset can be related to a system of forces and their lever arms about a particular fulcrum for upset. E.g. A lamp having an articulated arm extended horizontally over a fulcrum for upset will experience upset in the direction of arm extension if the product of the mass of those portions extended beyond the fulcrum for upset times the horizontal component of the length between the center of that mass and the fulcrum for upset exceeds the product of the mass on the other side of the fulcrum for upset times the horizontal component of the length between the center of that mass and said fulcrum for upset. Said fulcrums of upset occur at a plurality of points around the footprint perimeter. The horizontal component of the center of the total mass of a structure must lie within the footprint perimeter for the structure to be stable from upset. Thus, weight installed in the base, with its center of mass in the center of the base will have a shorter lever arm to said fulcrum for upset located under the articulated arm extension than will a fixed horizontal radius counterweight which rotates in opposition to the articulated arm. The fixed horizontal radius counterweight can create the same moment (product of mass times the horizontal component of lever arm length from the center of mass to the fulcrum of upset) with less weight because of its longer effective lever arm length. Therefore the weight of the entire structure including the counterweight can be less while having the same stability against upset. Counter weights exhibiting a variable horizontal radius may also have the advantage of a longer lever arm, but they have the disadvantage of their position being less predictable in relation to nearby objects. Further, prior art, having a variable horizontal radius counterweight wherein the counterweight acts on the opposite end of a vertically pivotable arm from the lamp structure may restrict the upward vertical movement of the lamp structure due to the counterweight moving opposite to the lamp structure and impacting its vertical support. The lamp of the invention does not have this limitation, because its counterweight is unaffected by vertical movement of the illumination structure. The lamp of the invention's articulated arm may be moved vertically upward and past the center of horizontal rotation, and because the horizontal component of the center of the total of all the lamp of the invention's mass lies within the footprint perimeter, the lamp is stable from upset. A mechanical stop keeps the arm from rotating beyond the stability limits. Another type of stability from upset exhibited by the lamp of the invention is a stability against applied horizontal forces to the lamp structure. Those skilled in the art will recognize that horizontal forces applied to the vertical structure of a lamp can create forces about said fulcrums of upset and destablize it. The horizontal force necessary to destablize a vertical structure becomes less as the distance between the point of force application, and the fulcrum for upset becomes greater for example, required force is less as the application point of the force moves up the vertical structure. The lamp of the invention limits the application of said horizontal destabilizing forces in the following way. The forces necessary to cause translation of the articulated arm, or rotation of the pivotable assembly (previously defined) are less than the force required to induce upset in the preferred embodiment. Thus above the spring attachment point 19, the structure tends to rotate or translate rather than be destabilized, and the lamp of the invention is generally stable for the new or modified position. Thus given that said articulated arm is fully extended vertically upwards, a force applied to the top of the arm will generally cause it to move to a new position rather than impart said force as a destabilizing moment referred to a fulcrum for upset. Further, the force necessary to destabilize the lamp of the invention by applying the force below the height of the spring attachment point 19 is less likely to occur because the required force is greater, and because its law vertical height above the supporting surface makes the encounter of a sufficient destabilizing force less likely to occur. In the preferred embodiment, said vertical height of the joints 20,22, is sufficient to allow the articulated arm to support the lamp structure over the center of an adjacent bed, or chair while being positioned to achieve the stability previously described. The lamp of the invention exhibits a stability against the mathmatical derivative of upsetting forces that prior art dues not. Prior art uses a variable horizontal radius counterweight to compensate vertical plane functions wherein the lamp of the invention uses springs 5,18. The result is that said articulated arm of the lamp of the invention having springs 5,18 may rapidly move in the vertical plane to absorb destabilizing forces to it that would otherwise lead to upset, where prior art's counterweight would resist the rapid movement of its arm in the vertical plane with a resisting force equal to the product of the mass of its counterweight times the acceleration imparted to the counterweight.

I claim:

1. A lamp comprising a stand member;

a pivotable structure supported on said stand member and pivotable about a vertical axis;

a counterweigth secured to said pivotable structure at a fixed distance from vertical axis and at a fixed elevation, and configured for rotation in unison with said pivotable structure; and a lamp structure carried by said pivotable structure, movable toward and away from said vertical axis, variably and pivotally extending in a radial direction, opposite the radial direction at which said counterweight is mounted, while said couterweight is secured at said fixed elevation.

2. The lamp of claim 1 wherein said counterweight is rigidly mounted on said pivotable structure.

3. The lamp of claim 2 wherein said lamp structure is articulated to translational provide pivotal movement substantially within a plane passing through said vertical axis.

4. The lamp of claim 3 wherein said lamp structure contains an integrated viewing lens.

5. The lamp of claim 4 wherein said stand member includes a plurality of legs and a central vertical tubular section, said legs having attachment means which allows the legs to assume a position generally parallel to said tubular section for storage purposes.

6. The lamp of claim 3 wherein said stand member contains a plurality of legs and a central vertical tubular section with said legs having attachment means which allows the legs to be folded toward said vertical axis when said stand member is not in use.

7. The lamp of claim 3 wherein said stand member includes a telescoping section.

8. The lamp of claim 3 wherein the center of gravity of said counterweight is never higher than the location of attachment between said pivotable structure and said stand member.

9. The lamp of claim 2 in which an attachment between said stand member and said pivotal structure restricts removal of said pivotal structure from said stand member whereby the lamp may be transported by grasping only said pivotal structure.

10. The lamp of claim 9 wherein a location of the attachment between said stand member and said pivotable structure is force dependent such that the stand member allowed to separate from the pivotable structure by applying a separating force along said vertical axis between said stand member and said pivotable structure said separating force exceeds the weight of said stand member, whereby the attachment between the stand member and the pivotable structure allow the lamp move by lifting the pivotable structure without separation of said stand member and said pivotable structure.

11. The lamp of claim 9 wherein said stand member and said pivotable structure are normally retained in the assembled condition and may be separated by manual intervention.

12. The lamp of claim 2 in which the center of gravity of the lamp always overlies a location within a horizontal polygon formed by a plurality of outermost straight line segments required to enclose the outward extremities of the stand member's footprint connecting adjoining locations at which said stand member engages a surface upon which said lamp is supported.

13. A lamp comprising a supporting stand member;

a pivotable structure secured to said stand member, and configured for pivotal movement about a substantially vertical axis;

a counterweight rigidly mounted on said pivotable structure at a fixed distance from said vertical axis and at a fixed elevation, and a lamp structure mounted on said pivotable structure which rotates in unison with said counterweight about said vertical axis, said lamp structure variably extends in a radial direction, opposite the radial direction in which said counterweight extends, while said counterweight is secured at said fixed elevation.

14. The lamp of claim 13 wherein said lamp structure is articulated to provide translational movement substantially in a plane passing through said vertical axis.

15. A lamp comprising a stand member;

a pivotable structure supported on said stand member and pivotable about a vertical axis;

a counterweight supported on said pivotable structure and mounted at a fixed distance from said vertical axis and at a fixed elevation;

a lamp structure carried by said pivotable structure, pivotable in unison with said counterweight about said vertical axis and pivotally extending in a radial direction, opposite the radial direction at which said counterweight is mounted, while said counterweight is at said fixed elevation said lamp structure being articulated to provide translational movement substantially in a plane passing through said vertical axis; and spring means provided in said articulated lamp structure for countering the weight of said articulated lamp structure.

* * * * *